United States Patent [19]

Propsom

[11] Patent Number: 4,624,464

[45] Date of Patent: Nov. 25, 1986

[54] GAME TURNTABLE

[75] Inventor: George F. Propsom, Racine, Wis.

[73] Assignee: Western Publishing Company, Inc., Racine, Wis.

[21] Appl. No.: 581,169

[22] Filed: Feb. 17, 1984

[51] Int. Cl.[4] ..... A63F 3/00

[52] U.S. Cl. ..... 273/280; 273/284

[58] Field of Search ..... 273/280, 284, 142 R

[56] References Cited

U.S. PATENT DOCUMENTS

| | | | |
|---|---|---|---|
| 731,760 | 6/1903 | Dorsey | 273/142 R |
| 1,780,256 | 11/1930 | Walss | 273/280 |
| 1,970,586 | 8/1934 | Wahlberg | 273/142 R |
| 2,682,408 | 6/1954 | Warns | 273/280 |
| 2,839,303 | 6/1958 | Baker | 273/280 |

FOREIGN PATENT DOCUMENTS

| | | | |
|---|---|---|---|
| 378833 | 9/1932 | United Kingdom | 273/142 R |

*Primary Examiner*—Richard C. Pinkham
*Assistant Examiner*—Benjamin Layno
*Attorney, Agent, or Firm*—Stewart L. Gitler; Martin P. Hoffman; Mitchell B. Wasson

[57] ABSTRACT

There is disclosed a game (10) comprised of a base (16) with a central hub (24), a playing board (28) which is removeably mounted on the base over the central hub and is held thereto so that it will not rotate with respect to the base. A transparent turntable (38) having a plurality of pockets (40) contained therein is rotatably mounted on the base by means of cooperating bearing means (44, 46) formed in the lower surface of the turntable and the upper surface of the central hub. The playing board includes a playing surface (29) with a number of spaces (34) printed thereon. The number of spaces on the playing surface and the pockets formed within the turntable are identical whereby in the starting position, the pockets, and the spaces will be aligned. During play, playing pieces (12) are placed in the pockets over spaces on the playing surface for movement over the playing surface. The turntable may be rotated during play to transport the playing pieces over different spaces on the playing surface.

2 Claims, 3 Drawing Figures

10
40
40
42
44
34s
38
40
47
29
28
32
30
36
34
36
35
34
36
18
26
24
46
25
16
18

GAME TURNTABLE

DESCRIPTION

1. Technical Field

This invention relates to games and more particularly to a game having a rotatable top surface overlaying a playing board for movement of playing pieces on the rotatable surface relative to the playing board.

2. Background

Prior art patents of possible relevance include U.S. Pat. No. 3,674,274 to Schur; 3,684,285 to Kane; 4,184,685 to Wilson; and 4,188,034 to Dempsey et al.

There are many types of games on the market, some of which have moveable or replaceable playing surfaces, or areas with playing surfaces underneath a fixed top surface and moveable with respect thereto. In addition, there are many known games in which playing pieces may be placed on or moved from different playing surfaces at various elevations.

The use of different play or moveable play surfaces allows games requiring greater skill and diversity to be played. In addition, such games often are more challenging to the players.

All of the above listed patents relate to games having various or changing playing surfaces or the replacement and/or the changing of playing pieces to enhance the play value of the game. However, none of these patents disclose a game having a rotatable transparent top surface overlaying a playing board.

DISCLOSURE OF THE INVENTION

In the preferred embodiment of the present invention, there is provided a base which supports a playing board. A transparent turntable on which playing pieces are supported overlays the playing board, and the playing pieces are moved from one space to another on the turntable, and may be caused to occupy different spaces with respect to the playing board by rotation of the transparent turntable.

BEST MODE FOR CARRYING OUT THE INVENTION

Turning now to the drawings, there shown is a game 10 on which one or more playing pieces 12 are moved. The number of spaces a player moves a playing piece on the game is controlled by the use of any appropriate means, such as a die, dice, or a spinner 14, as shown.

Figure 3:
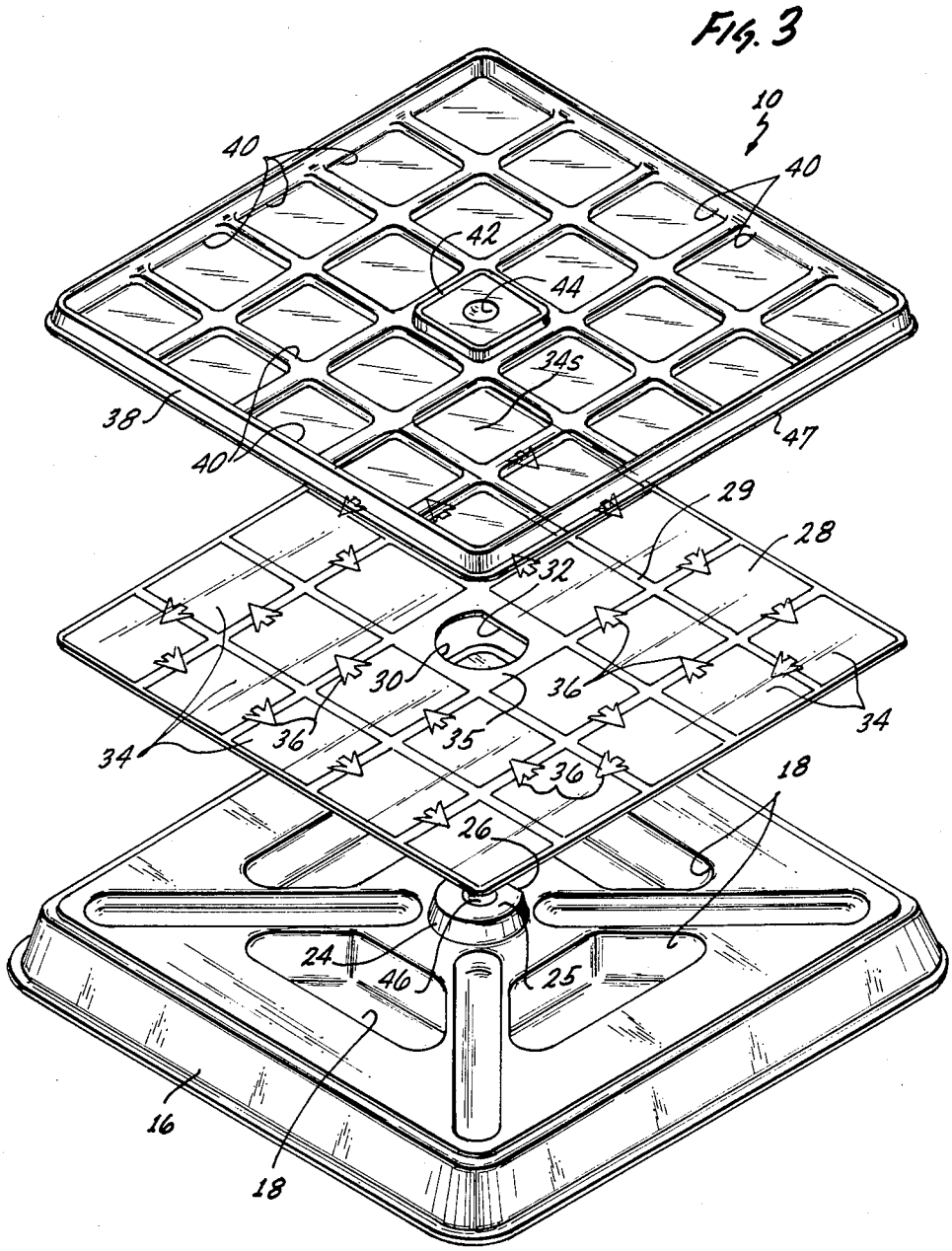
FIG. 3 is an exploded perspective view of the game base, playing board, and transparent turntable.

As shown more clearly shown in FIG. 3, the game 10 is comprised of a supporting base 16, a playing board 28, and a transparent overlay or turntable 38. The supporting base is made of any firm material, such as a molded plastic, is preferably rectangular in shape, as shown, and includes a plurality of molded cavities or hollow pockets 18. The pockets 18 may be used to hold or store the playing pieces 12, or the separate elements thereof, namely, bases 20 and upper cards 22, when not in use, or when transporting the game.

The game base 16 includes a top surface having an upstanding, central hub 24 secured to or molded integrally therewith. The central hub is preferably shaped as a frustrum including a cut-away or flattened portion 26, substantially parallel to one side of the base. The playing board 28 is placed over the frustrum shaped central hub of the game base by means of an opening 30 located centrally of the playing board. The opening 30 is substantially circular, with a flattened portion 32. The opening 30 and flatten portion 32 are of such a size as to cooperate with the flattened wall 26 and the base of the central hub 24 to prevent rotation of the playing board once it is resting on the base.

Figure 1:
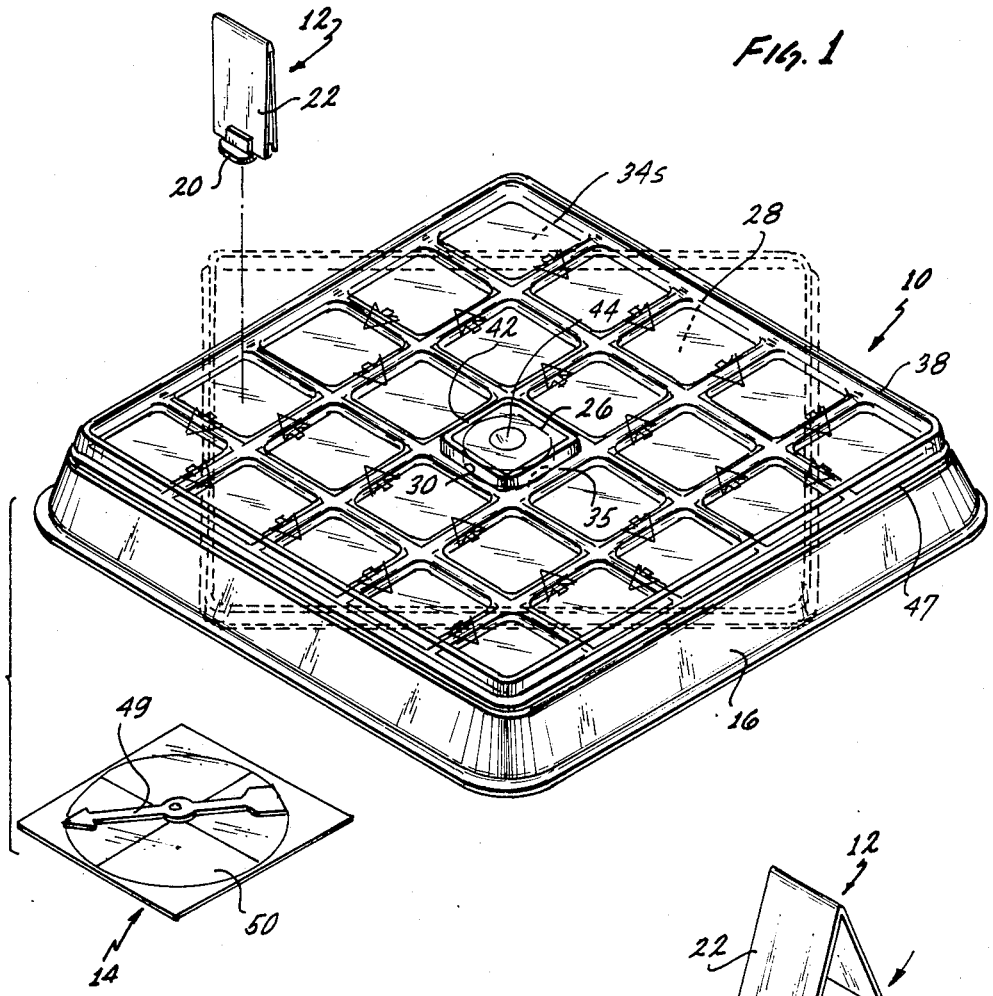
FIG. 1 is a perspective view of the game of the present invention and shows a playing piece spaced above a transparent turntable, as well as a spinner which may be used in playing games thereon.

The playing board includes a top surface 29, shown facing upwardly in FIGS. 1 and 3. The top surface 29 is provided with a design or the like, printed or fixed directly thereto in any convenient manner. As shown for illustration purposes only, the playing surface 29 may include a plurality of spaces or squares 34, with the opening 30 placed directly in a central space or square 35. Thus, the central square and opening are placed over the central hub 24 of the base. The play of the game, as explained more fully hereinafter, follows the direction of arrows 36 on surface 29, through the spaces along the playing board. The flow of the game may take any desired direction, but is shown as following a path starting at the upper left square 34S, when looking at FIGS. 1 and 3. Play then moves to the right, in the direction of the arrows 36. The arrows, of course, could be reversed. As shown by the arrows 36, play then drops down one row and moves from the right to the left. This pattern is repeated throughout the course of the game. If desired, the central space 35, through which the supporting hub 24 extends, is not counted and would be passed over during play. In addition, although it is to be understood that play could occur directly on the top surface 29 of playing board 28, following the arrows 36 along the spaces as indicated above, the game is preferrably played using the transparent overlay or turntable 38.

The transparent overlay or turntable 38 is made of any suitable material, such as a transparent plastic, and is molded in substantially the same form as the base 16, and the playing board 28. A plurality of pockets 40, preferably the same shape as spaces or squares 34 on playing surface 29, and corresponding in number to these spaces, are formed in the turntable. That is, the plastic turntable 38 is preferrably molded, with pockets 40, equal in number to the spaces 34, to enable the bases of the playing pieces 12 to be inserted in and held within the pockets over the playing surface. The playing pieces are moved from one pocket to another in the turntable overlying the playing surface.

Turntable 38 also includes an upstanding or upwardly extending central space or square 42, fixed to or molded in the turntable 38. Square 42 extends above the upper surface of the turntable 38, and the pockets 40, and includes a downwardly extending depression, dimple or bearing 44. The bearing 44 is inserted in and is supported on a corresponding depression, dimple or bearing 46 formed in the top surface of central hub 24 on base 16. In this manner, the transparent plastic overlay or turntable 38 is supported on the central hub of the base, over the playing surface 29 of the board 28, and may be rotated with respect to the base and the playing surface by means of the bearings 44, 46. That is, the turntable may be rotated by grasping any of its outside edges 47, or the edges of the central square 42 and turning the same in the desired direction.

Figure 2:
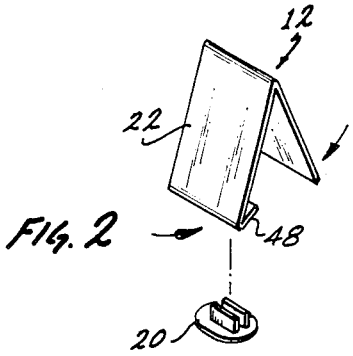
FIG. 2 is an enlarged exploded perspective view of one of the playing pieces.

Use of the game 10 will now be explained, using one type of a game to be played thereon as an example. It should be understood, of course, that more than one type of game may be played on the present invention. Playing pieces of any type, such as 12, shown in FIG. 2, assembled by folding the two halves of the top portion 22 together and inserting the two halves with enlarged lower portion 48 into the base 20, may be used. The bases 20 of the playing pieces may be of different colors, to allows different players and/or teams of players to play variations of games. The first player, chosen in any acceptable manner, then either throws a die, a pair of dice, or spins a pointer 49 fixed to a base 50 of the spinner 14, in a well known manner. The spinner base 50 may be provided with numerals or other indicating means directly thereon whereby the player spinning the pointer is instructed on how to move his playing piece. For example, the indicated number of spaces the player is to move in the correct direction from the starting square 34S. It should be understood that during play, the playing pieces actually sit in the pockets 40 on the top surface of the transparent turntable or overlay 38, above the spaces 34 on the playing surface 29. Players take their turns, starting and moving their playing pieces in the turntable, above the playing surface 29, in the direction of play, indicated by the arrows 36, in a back and forth pattern. The spaces on the playing surface 29 may be marked in any desired manner, and may be provided with instructions, such as to draw cards (not shown) which give further instructions. Or, any number of specially marked spaces may be provided, and/or the rules of the game may be changed as the players wish, or instructions provided with the game direct.

As play continues and a player lands on an indicated space, or is instructed to do so by a card or the like, the transparent overlay or turntable 38 is rotated, for example, one-quarter turn in the clockwise direction, to the position shown in broken line in FIG. 1. This clockwise turning is in keeping with the direction of the arrows 36, indicating the flow or play of the game. However, in some play situations the turntable could be turned in a counter-clockwise direction. By the rotation or turning of the turntable a predetermined or indicated amount, for example, the approximately one-quarter turn to the position shown in broken line in FIG. 1, all playing pieces in pockets 40 on the turntable will be similarly rotated until they are over or occupy different spaces relative to the underlying playing surface 29. Depending on the rules of the game, any instructions on the new spaces over which the playing pieces have been rotated may be disregarded or followed. Play continues until a player or team of players is determined the winner. However, during play, play will be continuously disrupted by the turning of the upper transparent turntable carrying the playing pieces. This turning transports or carries the playing pieces to new locations over other spaces on the playing surface 29 thereby further heightening the interest of the players in the game.

It therefore can be seen that a new and novel game, having a unique transparent turntable overlying a printed game board removeably supported on a base, has been disclosed. The turntable rotates with respect to the base and the printed playing board mounted on the base. By rotation of the turntable during play, playing pieces supported on the turntable are displaced or reoriented with respect to the playing surface, thereby adding interest and challenge to the playing of the game.

The invention allows any number of games to be played, by merely replacing the removeable playing board 28 with different boards having different playing surfaces 29 and/or using different instructions with the various playing boards.

The particular form of the invention described herein and illustrated in the accompanying drawings is a preferred embodiment, and various changes in the size, shape, materials and arrangement of parts may be made without departing from the spirit of the invention as set forth in the attached claims.

I claim:

1. A game comprising:

(a) game base including a plurality of hollow pockets and a frustum shaped central hub;

(b) a playing board which is removably mounted to said base in a non-rotatable position; and (c) a transparent overlay rotatably mounted to said base over said playing board for rotation with respect to said base and said playing board on said frustum shaped central hub extending between the base and the overlay, and whereby said overlay contains pockets therein and wherein said base is molded from plastic and said frustum shaped central hub having a flattened portion formed integrally therein and said hub having a top surface with a bearing formed therein, the central hub further including a central depression formed in the top surface thereof cooperating with a corresponding central depression formed centrally in the overlay, whereby the overlay may be rotated about the depression with respect to the base and the playing board.

2. A game as described in claim 1 wherein said playing board has a substantially circular opening through the center thereof, the opening having a flattened portion which cooperates with said flattened portion of said hub to prevent rotation of said playing board when the playing board is removably supported on the base with said central hub extending through the opening.

* * * * *